US009648406B2

(12) United States Patent
Zhang

(10) Patent No.: US 9,648,406 B2
(45) Date of Patent: May 9, 2017

(54) SPEAKER

(71) Applicant: Yang Zhang, Shenzhen (CN)

(72) Inventor: Yang Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/011,063

(22) Filed: Jan. 29, 2016

(65) Prior Publication Data

US 2017/0013341 A1 Jan. 12, 2017

(30) Foreign Application Priority Data

Jul. 9, 2015 (CN) ..... 2015 2 0514010 U

(51) Int. Cl.

| | |
|---|---|
| ***H04R 9/00*** | (2006.01) |
| ***H04R 1/06*** | (2006.01) |
| ***H04R 9/06*** | (2006.01) |
| *H04R 31/00* | (2006.01) |
| *H04R 7/02* | (2006.01) |

(52) U.S. Cl.

CPC ..... *H04R 1/06* (2013.01); *H04R 9/06* (2013.01); *H04R 7/02* (2013.01); *H04R 31/006* (2013.01); *H04R 2307/025* (2013.01); *H04R 2307/207* (2013.01); *H04R 2499/11* (2013.01)

(58) Field of Classification Search

CPC .... H04R 9/00; H04R 29/003; H04R 2209/00; H04R 2209/41; H04R 7/00; H04R 2207/00; H04R 7/06; H04R 7/04

USPC ..... 381/409, 423–424, 431, 396

See application file for complete search history.

(56) References Cited

U.S. PATENT DOCUMENTS

| | | | | |
|---|---|---|---|---|
| 6,269,167 | B1 * | 7/2001 | Mango, III | H04R 1/06 381/409 |
| 7,864,977 | B2 * | 1/2011 | Sadaie | H04R 1/227 381/431 |
| 8,311,264 | B2 * | 11/2012 | Lee | H04R 9/022 381/431 |
| 8,705,788 | B2 * | 4/2014 | Xu | H04R 31/006 381/409 |
| 8,938,086 | B2 * | 1/2015 | Zhang | H04R 9/025 381/409 |
| 8,953,834 | B2 * | 2/2015 | Kim | H04R 9/047 381/431 |
| 2005/0276437 | A1 * | 12/2005 | Kaiya | H04R 1/06 381/409 |

* cited by examiner

*Primary Examiner* — Suhan Ni
(74) *Attorney, Agent, or Firm* — Na Xu; IPro, PLLC

(57) ABSTRACT

A speaker is provided in the present disclosure. The speaker includes a membrane, a solder pad formed on the membrane, a voice coil connected to the membrane, and a connecting wire connected to the solder pad. The connecting wire is configured for receiving an electric signal for driving the voice coil. The voice coil includes a coil portion for driving the membrane to vibrate, and a line lead portion led out from an end of the coil portion; the line led portion is connected to the solder pad.

8 Claims, 2 Drawing Sheets

SPEAKER

FIELD OF THE DISCLOSURE

The present disclosure relates to electro-acoustic transducer technologies, and more particularly, to a speaker applicable to a mobile device for producing audible sound.

BACKGROUND

Speakers are widely applied in mobile devices, such as mobile phones, tablet computers or laptop computers, for converting electrical signals into audible sounds.

A typical speaker includes a membrane and a voice coil connected with the membrane; the voice coil is used to drive the membrane to perform vibration and produce sounds. Generally, the voice coil utilizes a lead wire to receive electric signal, and the lead wire is generally fixed to a holder of the speaker.

However, the lead wire of the voice coil may suffer flexure vibration when the voice coil drives the membrane to vibrate, and an extra space needs to be reserved in the speaker for the flexure vibration of the lead wire, which is not good for miniaturization of the speaker. Moreover, the lead wire is liable to collide with the holder or the membrane during flexure vibration; this may deteriorate a sound quality of the speaker. In addition, the lead wire may also be over-stretched and broken off when the flexure vibration is too fierce; therefore, reliability of the speaker is low.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
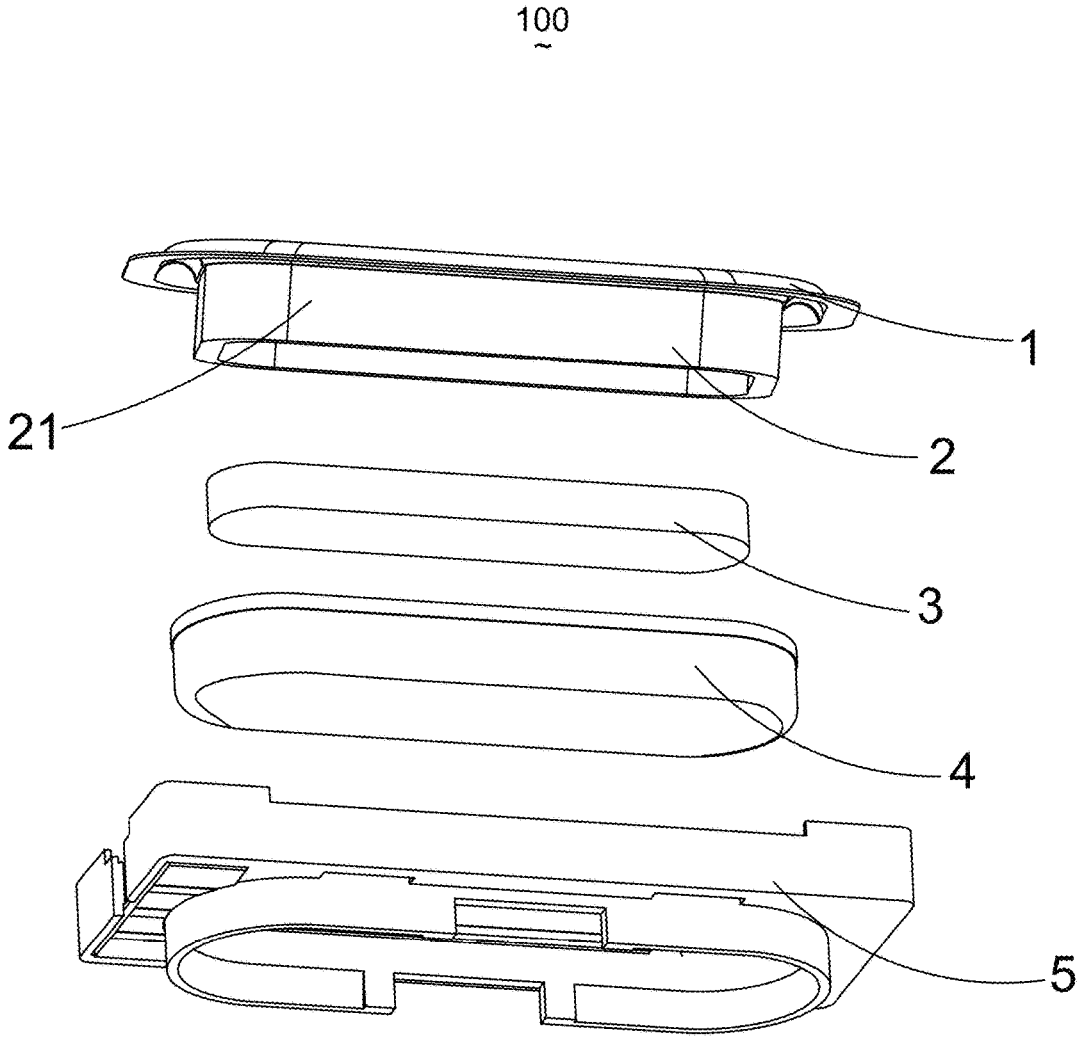
FIG. 1 is an exploded view of a speaker according to an embodiment of the present disclosure.
Figure 2:
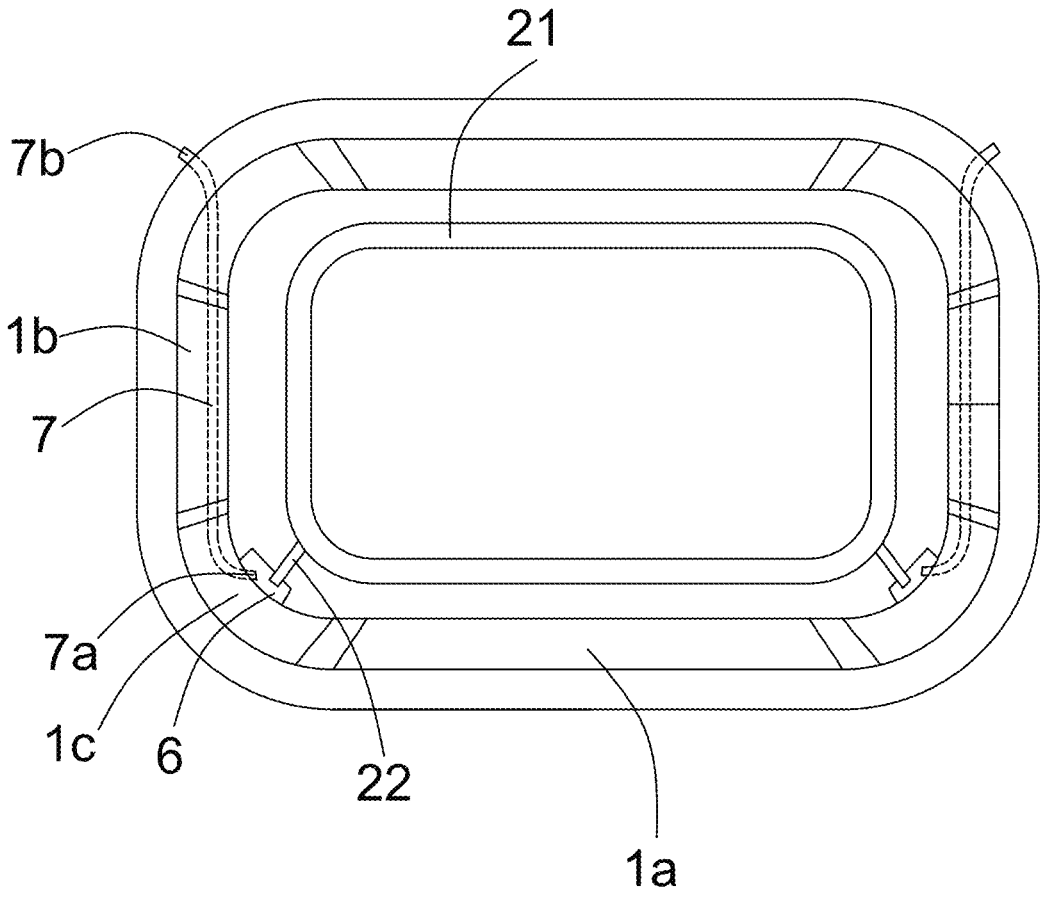
FIG. 2 is a planar, assembled view of the speaker of FIG. 1.

Referring to FIGS. 1-2, a speaker 100 according to an embodiment of the present disclosure is shown. The speaker 100 may be a micro speaker applicable to a mobile device such as a mobile phone, a personal digital assistant, a tablet computer, a laptop computer, or the like. The speaker 100 includes a holder 5, a yoke 4 received in the holder 5, a magnet 3 received in the yoke 4, a voice coil 2 and a membrane 1.

The voice coil 2 is connected with the membrane 1, and includes a coil portion 21 and a line lead portion 22. The coil portion 21 is configured for driving the membrane 1 to vibrate and produce audible sounds. The line lead portion 22 is led out from an end of the coil portion 21.

The membrane 1 includes a pair of opposite long edges 1*a*, a pair of opposite short edges 1*b*, and four curved edges 1*c*. The four curved edges 1*c* are arranged at four corners of the membrane 1, and the long edges 1*a* and the short edges 1*b* are connected end to end by four curved edges 1*c* respectively to form a ring-shaped periphery.

Moreover, the speaker 100 further includes a solder pad 6 and a connecting wire 7. The solder pad 6 is formed on the membrane 1, for example, in the present embodiment as illustrated in FIG. 2, the solder pad 6 is formed at one of the curved edges 1*c* of the membrane 1. The line lead portion 22 of the voice coil 2 is drawn out from the coil portion 21 at a corresponding corner of the voice coil 2 adjacent to the solder pad 6, and an end of the line lead portion 22 is electrically connected and fixed onto the solder pad 6.

The connecting wire 7 includes a first end 7*a* and a second end 7*b* opposite to the first end 7*a*. The first end 7*a* of the connecting wire 7 is connected to the solder pad 6, and the second end 7*b* of the connecting wire 7 is connected to an input terminal of the speaker 100 for receiving an electric signal for driving the voice coil 2. The connecting wire 7 may extend from the solder pad 6 to the input terminal of the speaker 100 via an adjacent short edge 1*b* of the membrane 1.

In the present embodiment, the membrane 1 may be a silicone diaphragm which is formed by silicone injection molding process, the solder pad 6 may be integrated onto the corresponding curved edge 1*c* of the membrane 1 by injection process or hot pressing process. Furthermore, material of the connecting wire 7 can be selected from either conductive carbon fiber or grapheme, and similarly, the connecting wire 7 may also be integrated onto the corresponding shot edge 1*b* of the membrane 1 by the injection process or the hot pressing process.

In the speaker 100 as provided in the present disclosure, the line lead portion 22 of the voice coil 2 is fixed onto the solder pad 6 formed on the membrane 1, with this configuration, when the voice coil 2 drives the membrane 1 to vibrate, the line lead portion 22 would not perform any flexure vibration, this can not only save an internal space of the speaker 100 and enhance miniaturization of the speaker 100, but also protect the line lead portion 22 from colliding with the holder 5 or the membrane 1 and being over-stretched. Therefore, both the sound quality and the reliability of the speaker 100 can be improved.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a membrane including two opposite long edges, two opposite short edges, and four curved edges, the four curved edges arranged at four corners of the membrane; the long edges and the short edges connected end to end by four curved edges respectively;

a solder pad formed on at least one of the curved edges of the membrane;

a voice coil connected to the membrane; and a connecting wire connected to the solder pad and for receiving an electric signal for driving the voice coil;

wherein the voice coil comprises a coil portion for driving the membrane to vibrate, and a line lead portion led out from an end of the coil portion, the line lead portion is connected to the solder pad.

2. The speaker of claim 1, wherein the membrane is a silicone diaphragm formed by silicone injection molding process.

3. The speaker of claim 2, wherein the solder pad is integrated onto the corresponding curved edge of the membrane by injection process or hot pressing process.

4. The speaker of claim 2, wherein the connecting wire comprises a first end connected to the solder pad, and a second end connected to an input terminal of the speaker for receiving the electric signal for driving the voice coil.

5. The speaker of claim 4, wherein the connecting wire extends from the solder pad to the input terminal of the speaker via an adjacent short edge of the membrane corresponding to the curved edge.

6. The speaker of claim 5, wherein material of the connecting wire is selected from either conductive carbon fiber or grapheme.

7. The speaker of claim 6, wherein the connecting wire is integrated onto the adjacent short edge of the membrane by the injection process or the hot pressing process.

8. The speaker of claim 1, further comprising a holder, a yoke received in the holder, and a magnet received in the yoke.

* * * * *